United States Patent [19]

Gerhard

[11] Patent Number: 4,840,282

[45] Date of Patent: Jun. 20, 1989

[54] PRESSURE-RESISTANT TANK

[75] Inventor: Helmut Gerhard, Weitefeld, Fed. Rep. of Germany

[73] Assignee: Westerwaelder Eisenwerk Gerhard GmbH, Weitefeld, Fed. Rep. of Germany

[21] Appl. No.: 213,824

[22] Filed: Jun. 30, 1988

[30] Foreign Application Priority Data

Aug. 10, 1987 [DE] Fed. Rep. of Germany ..... 8710906

[51] Int. Cl.[4] ..... B65D 88/06

[52] U.S. Cl. ..... 220/1.5; 220/5 A; 220/69; 220/71; 220/72.1

[58] Field of Search ..... 220/5 A, 1.5, 69, 71, 220/72.1, 70.1, 401

[56] References Cited

U.S. PATENT DOCUMENTS

| | | | |
|---|---|---|---|
| 3,948,408 | 4/1976 | Trout et al. | 220/5 A |
| 4,282,823 | 8/1981 | Santi | 220/5 A |
| 4,421,243 | 12/1983 | Taquoi | 220/5 A |
| 4,481,975 | 11/1984 | Buckley | 220/5 A |
| 4,593,832 | 6/1986 | Gerhard | 220/5 A |

FOREIGN PATENT DOCUMENTS

| | | |
|---|---|---|
| 6601008 | 2/1969 | Fed. Rep. of Germany . |
| 1946737 | 9/1969 | Fed. Rep. of Germany . |
| 3517289 | 11/1985 | Fed. Rep. of Germany . |
| 431385 | 8/1967 | Switzerland . |

*Primary Examiner*—Joseph Man-Fu Moy
*Attorney, Agent, or Firm*—Barnes & Thornburg

[57] ABSTRACT

A pressure-resistant tank has a jacket composed of a plurality of parallel extending part-cylindrical shells (10) with any adjacent pair of shells (10) being interconnected by a tubular longitudinal bar (15) extending along the bead area formed between said adjacent shells. Opposite longitudinal bars (15) are interconnected by tubular tie rods (18) which traverse the interior of the tank. Reinforcing pipe sections (20) are inserted into the longitudinal bars (15) in the areas where the tie rods (18) are joined to the longitudinal bars (15).

9 Claims, 2 Drawing Sheets

PRESSURE-RESISTANT TANK

DESCRIPTION

Figure 1:
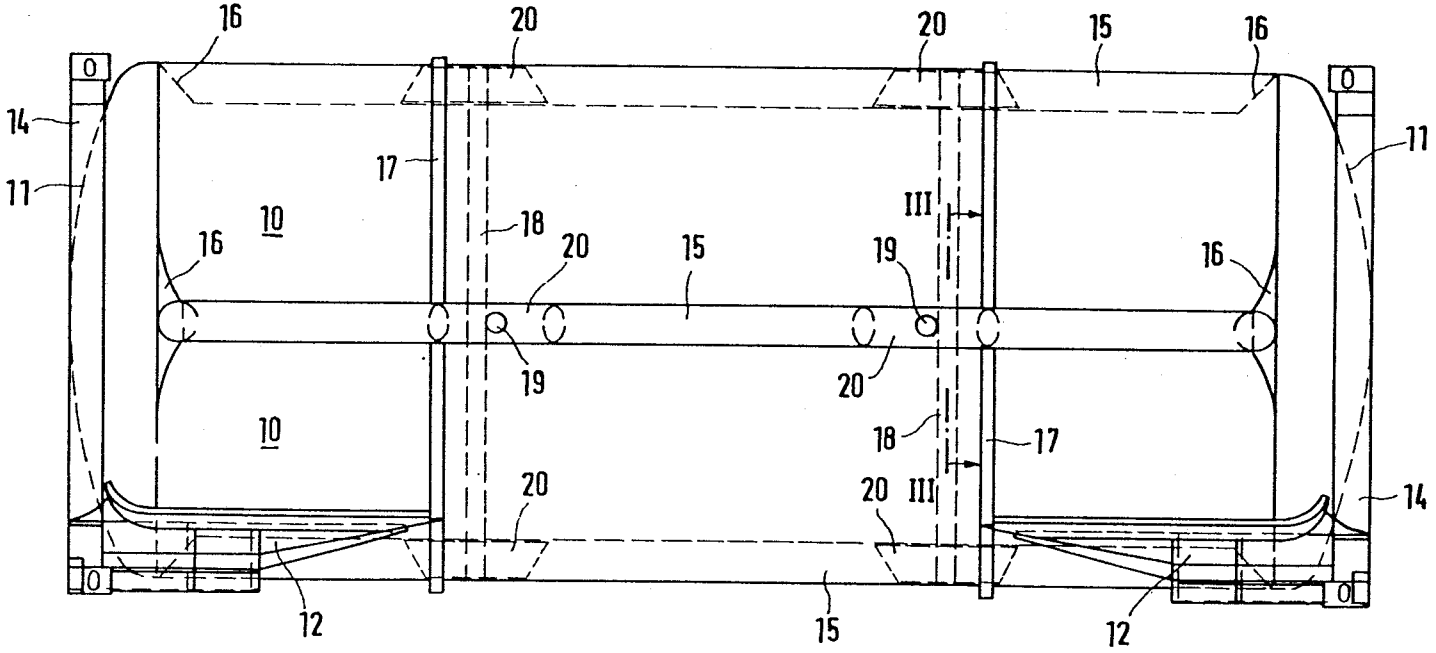

A pressure-resistant tank is known from DE-C-2,253,235, the tank jacket of which is formed of four part-circular cylindrical shell elements and a pair of tank heads and is inserted between end frame structures of a tank container. For L-section beams extend between these end frame structures outside the tank jacket, with one flange of each beam protruding into the bead formed between adjacent shell elements. Tie rods traverse the interior of the tank, penetrate the tank jacket in the area of the beads and have their ends welded to the said flanges of mutually opposite beams. Inside the tank jacket, the tie rods are formed tubular to increase their stiffness.

The known tank requires heavy end frame structures to fix the massive section beams and therefore has a high tare weight. Moreover, a relatively large number of tie rods is provided which not only further increase the tare weight of the tank but also result in a more difficult manufacture and considerably obstruct a cleaning of the tank interior.

DE-C-2,007,142 discloses another tank container having upper and lower curved jacket shell elements which are joined to upper and lower tubular bars extending in the longitudinal direction of the container and being interconnected by a tension wall which subdivides the whole container into two chambers. This container is again expensive to manufacture and has a high tare weight due to the tension wall extending throughout the length of the container. Also in this case, cleaning of the tank interior is difficult due to the presence of the separation wall.

It is thus an object of the present invention to devise a tank which is as pressure-resistant as possible at minimum tare weight, which is easy to clean and inexpensive to manufacture.

In view of this object, the pressure-resistant tank of the present invention has a jacket which includes a plurality of longitudinal bars formed with tubular cross-sections and extending parallel to a longitudinal tank axis, a plurality of part-cylindrical shell elements fitted between respective ones of said longitudinal bars, with the axes of said shell elements extending parallel to said tank axis, a pair of tank heads connected to the ends of said part-cylindrical shell elements, a number of individual tie rods traversing the interior of said tank and interconnecting opposite ones of said longitudinal bars, and reinforcing pipe sections inserted into said tubular longitudinal bars in the areas in which said tie rods are connected to said longitudinal bars.

According to the invention, the tubular longitudinal bars inserted between respective adjacent jacket shell elements need not be excessively heavy because they are reinforced by inserted sections of a further pipe provided in the areas where the tie rods are connected. Due to this type of reinforcement of the tubular longitudinal bars, a small number of tie rods will suffice. At a given pressure resistance, the forces occurring in the small number of tie rods are readily introduced into the longitudinal bars without causing inadmissible peak stress or bending. A small number of tie rods is fabourable from the points of view of manufacture, tare weight and cleaning of the tank interior.

While it is known from DE-A-3,517,289 in connection with a freight container to insert connecting elements into blind holes of U-section reinforcing members that may in turn be reinforced by flat iron plates, the container known from this document is not a pressure-resistant container of the type with which the invention is concerned. Moreover, the particular feature of the invention, according to which an interior pipe section is inserted into a tubular longitudinal bar at the location where a tie rod is joined to the longitudinal bar, is not realized in this prior art.

The same applies to the rectangular tank disclosed in CH-A-431,385, in which a tubular tie rod is fixed on the outer side of the planar tank walls by conventional reinforcing disks welded to the tank walls.

In a preferred embodiment of the invention, the reinforcing pipe sections are bevelled in such a manner that they have their maximum length next to the tank axis. Due to these bevels, the pipe sections end in resilient tongues that create smooth transitions between the reinforced and non-reinforced portions of the longitudinal bars.

In another preferred embodiment, the tension rods are tubular, completely penetrate the longitudinal bars and are b welded thereto at both locations of penetration. High strength of the tie rods themselves and of their connections to the longitudinal bars is thereby attained. Relative movement between the tubular longitudinal bar and the pipe section inserted therein is presented by welds performed along edges of cut-outs provided in the longitudinal bars at locations where the pipe sections are inserted.

It is further advantageous to bevel each longitudinal bar at both ends in such a manner that it has its minimum length next to the tank axis, and to close these bevelled ends by sheet metal pieces integrally formed with the tank heads. These features are favourable with respect to the cleaning of the tank interior and also with respect to manufacture. In an alternative embodiment, the ends of the tubular longitudinal bars may be closed off by separate sheet metal pieces which may extend over part of the respective tank head to form stress-relieving and reinforcing elements.

In case the tank jacket is made of special steel or other high-quality material, it may be advantageous not to manufacture the tubular longitudinal bars from such expensive tank material but instead to cover their portions facing the tank interior with part-cylindrical sleeves made of the tank material. In any case, the reinforcing pipe sections disposed inside the longitudinal bars will be made of less expensive material which, on the other hand, may have higher strength properties.

Preferably, the tank jacket is composed of four shell elements, the axes of which define the corners of a rectangle, and each shell element is made of rolled metal sheet that is curved transversely to the rolling direction and extends across the overall length of the tank as one single piece. With the rolling widths nowadays available, and in view of the usual tank profiles, each of the four shell elements can be made of one single piece and does not have to be made up of a plurality of separate rings extending in the transverse direction, as is true with conventional cylindrical containers. This results in a reduced overall welding length and simplifies the assembly. In a further preferred embodiment of the invention, the tubular longitudinal bars and tubular tie rods are formed as parts of a closed tube system for circulating a cooling or heating fluid. Temperature control of the tank content is thus made possible without requiring additional weight-increasing measures.

Figure 2:
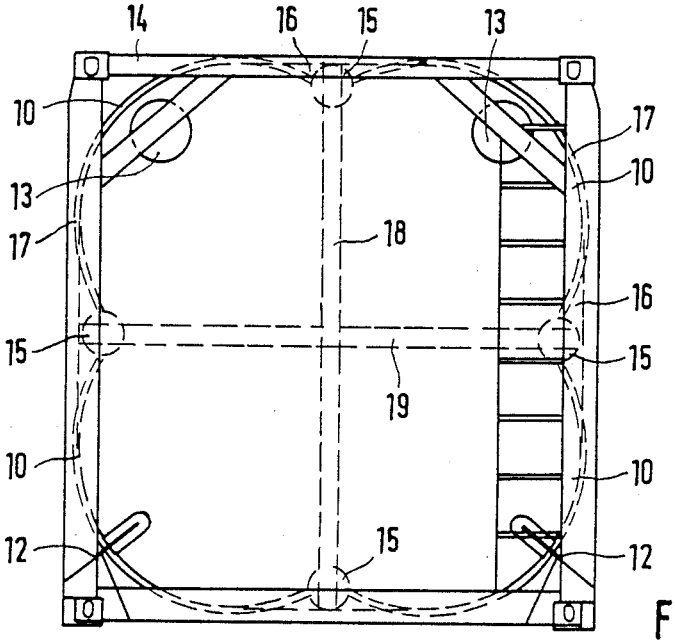
Figure 3:
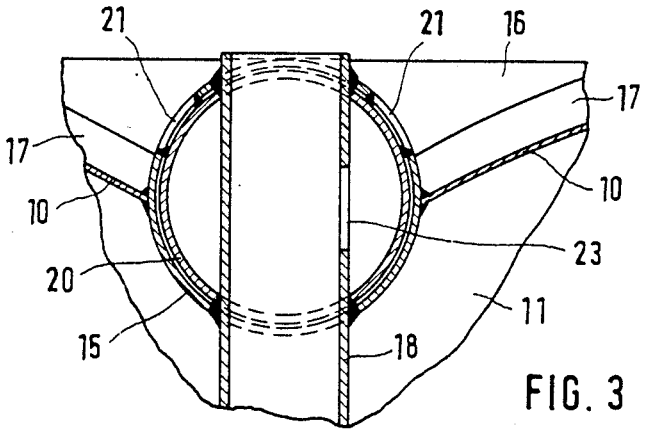
Figure 4:
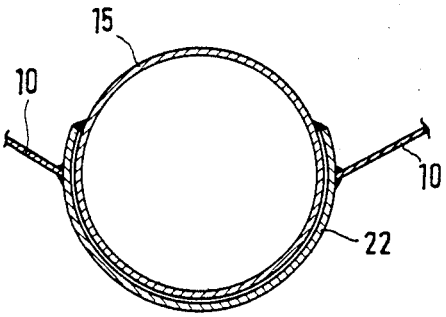

Preferred embodiments of the invention will now be described with reference to the drawings, in which FIG. 1 is a side view of a pressure-resistant tank fitted between two container end frame structures, FIG. 2 is an end view of the tank shown in FIG. 1, FIG. 3 is an enlarged partial section taken along the line III—III of FIG. 1, and FIG. 4 is a partial section through one longitudinal bar according to a modified embodiment.

According to FIGS. 1 and 2, the tank is composed of four parallel part-circular cylindrical shell elements 10 and two tank end heads 11. As appears from the end view of FIG. 2, the tank has a clover-leaf shaped cross-section with the axes of the four shell elements 10 defining the corners of a rectangle. Lower saddle pieces 12 and upper support elements 13 connect the tank to two container end frame structures 14.

A tubular longitudinal bar 15 extends parallel to the tank axis in the bead area between each pair of adjacent shell elements 10. As will be particularly clear from the upper part of FIG. 1, both ends of each tubular longitudinal bar 15 are bevelled at 45° or less in such a manner that the minimum length of the bar 15 is next to the tank axis and its maximum length reaches the location where the respective tank head is attached. Four spandrel-shaped sheet metal pieces 16 are integrally formed at each tank head 11 and bent at the above-referred angle of 45° or less. Each metal piece engages in the respective bead area between two jacket shell elements 10 and simultaneously closes off that portion of the bevelled end face of each tubular longitudinal bar 15 which is outside the jacket shell elements 10.

The tank jacket is further surrounded by two reinforcing rings 17 which, as shown in FIG. 2, follow the substantially clover-leaf shaped profile of the tank. Tubular tie rods 18, 19 extend perpendicular to the tank axis and traverse the tank interior. One vertical tie bar 18 and one horizontal tie bar 19 are each disposed immediately adjacent so as to contact each other in the area of intersection and may be joined to each other for further reinforcement. A total of four tie bars 18, 19 are provided at a tank length of 20 feet (6058 mm).

Each end of each tie rod 18, 19 completely penetrates the respective longitudinal bar 15, with a short length protruding from the outside thereof. In the area of penetration, the longitudinal bar 15 is reinforced by a pipe section 20 inserted into the tubular bar 15. As shown in FIG. 1, the ends of each pipe section 20 is bevelled in such a manner that the maximum length of the pipe section 20 is next to the tank axis. A gradual stress transition is thereby achieved from the reinforced portion of the longitudinal bar 15 to the non-reinforced portion, with the longest inner tongue-shaped end portions of the pipe section 20 providing a certain elasticity.

As may be seen from the sectional view of FIG. 3, the end of the tie bar 18 is welded to the longitudinal bar 15 as well as to the pipe section 20 at both locations of penetration situated inside and outside the tank. Since the reinforcing action of the pipe section 20 is fully achieved only if the pipe section is prevented from moving relative to the tubular bar 15, these two elements are fixed to each other by welds performed along edges of cut-outs 21 that are provided in the tubular bar 15. Both jacket shell elements 10 are welded to the tubular bar 15.

While the shell elements 10, tie rods 18, 19 and longitudinal bar 15 consist of tank material, such as special steel if so required according to the usage of the tank, the pipe sections 20 that are not contacted by the load are made of high-strength constructional or fine-grain steel.

Further saving of high-quality tank material may be achieved by manufacturing the longitudinal bar 15 of less expensive material and surrounding it, as shown in FIG. 4, at the portion inside the tank by a part-cylindrical sleeve 22 of tank material. The longitudinal edges of the sleeves 22 are welded to the respective bar 15 on the outside of the tank. In this case, the jacket shell elements will be welded to the sleeves 22.

Given the typical dimensions of a land tank container, i.e. a height of 2600 mm and a width of approximately 2500 mm, and using tubular longitudinal bars 15 of a diameter of approximately 200 mm, the clover-leaf type configuration shown in FIG. 2 requires jacket shell elements having an arc length of slightly less than 2000 mm.

Sheet metal of this width may be manufactured in a modern cold-rolling process. The use of the tubular bars 15 in the manner shown thus permits to curve the jacket shell elements 10 transversely to the rolling direction with the result that four integral jacket shell elements 10 extending over the entire tank length may be used, in contrast to conventional tank jackets that are made up of a plurality of transversely extending rings.

The tubular longitudinal bars 15 and tubular tie rods 18, 19 may be used for circulating a cooling or heating fluid which is supplied by external inlet pipes and connectors (not shown). In this case the tie rods 18, 19 will be provided with openings 23 (FIG. 3) at those locations at which they penetrate the longitudinal bars 15 in order to form a coherent tube system.

What is claimed is:

1. A pressure-resistant tank the jacket of which includes a plurality of longitudinal bars formed with tubular cross-sections and extending parallel to a longitudinal tank axis, a plurality of part-cylindrical shell elements fitted between respective ones of said longitudinal bars, the axes of said shell elements extending parallel to said tank axis, a pair of tank heads connected to the ends of said part cylindrical shell elements, a number of individual tie rods traversing the interior of said tank and interconnecting opposite ones of said longitudinal bars, and reinforcing pipe sections inserted into said tubular longitudinal bars in the areas in which said tie rods are connected to said longitudinal bars.

2. The tank of claim 1, wherein said pipe sections are bevelled at both ends in such a manner that the maximum length of each pipe section is closest to said tank axis.

3. The tank of claim 1, wherein said tie rods are tubular.

4. The tank of claim 1, wherein said tie rods completely penetrate said longitudinal bars and pipe sections inserted therein and are welded to said bars and pipe sections at both locations of penetration.

5. The tank of claim 1, wherein cut-outs are provided in said tubular longitudinal bars in the areas where they contain said pipe sections, said pipe sections being fixed to said longitudinal bars by being welded to edges of said cut-outs.

6. The tank of claim 1, wherein said longitudinal bars are bevelled at both ends in such a manner that the minimum length of each bar is adjacent to said tank axis, both ends of said longitudinal bars being closed by sheet metal pieces integrally formed on said tank heads.

7. The tank of claim 1, wherein the portions of said longitudinal bars located inside said tank are surrounded by part cylindrical sleeves consisting of tank material, the longitudinal edges of said sleeves being located outside said tank jacket and welded t said longitudinal bars.

8. The tank of claim 1, wherein said tank jacket is composed of four shell elements the axes of which define the corners of a rectangle, said shell elements being formed of rolled metal sheets which are curved transversely to the rolling direction and extend as single pieces across the entire length of said tank jacket.

9. The tank of claim 3, wherein said tubular longitudinal bars and tubular tie rods are parts of a closed tube system for circulating a cooling or heating fluid.

* * * * *